US010661338B2

(12) United States Patent
Zajac et al.

(10) Patent No.: US 10,661,338 B2
(45) Date of Patent: May 26, 2020

(54) DAMAGE TOLERANT ALUMINIUM MATERIAL HAVING A LAYERED MICROSTRUCTURE

(75) Inventors: Stanislaw Zajac, Farsta (SE); Jonas Braam, Norsholm (SE)

(73) Assignee: Hydro Extruded Solutions AB, Finspång (SE)

( * ) Notice: Subject to any disclaimer, the term of this patent is extended or adjusted under 35 U.S.C. 154(b) by 494 days.

(21) Appl. No.: 13/643,088

(22) PCT Filed: Apr. 26, 2010

(86) PCT No.: PCT/EP2010/055504

§ 371 (c)(1),
(2), (4) Date: Dec. 20, 2012

(87) PCT Pub. No.: WO2011/134486

PCT Pub. Date: Nov. 3, 2011

(65) Prior Publication Data

US 2013/0202477 A1 Aug. 8, 2013

(51) Int. Cl.

| | |
|---|---|
| ***B22D 25/06*** | (2006.01) |
| ***C22C 21/02*** | (2006.01) |
| ***C22C 21/08*** | (2006.01) |
| ***C22F 1/04*** | (2006.01) |
| ***C22F 1/05*** | (2006.01) |
| ***C22C 21/00*** | (2006.01) |

(52) U.S. Cl.

CPC ..... *B22D 25/06* (2013.01); *C22C 21/00* (2013.01); *C22C 21/02* (2013.01); *C22C 21/08* (2013.01); *C22F 1/04* (2013.01); *C22F 1/05* (2013.01); *Y10T 29/49* (2015.01)

(58) Field of Classification Search

CPC ..... C22C 21/00; B22D 25/06
USPC ..... 420/535
See application file for complete search history.

(56) References Cited

U.S. PATENT DOCUMENTS 3,346,371 A 10/1967 Jagaciak
4,897,124 A 1/1990 Matsuo et al.
(Continued)

FOREIGN PATENT DOCUMENTS

CN 101407875 4/2009
CN 101407876 4/2009
(Continued)

OTHER PUBLICATIONS

Eskin, D. G. Physical Metallurgy of Direct Chill Casting of Aluminum Alloys. Boca Raton: CRC/Taylor & Francis, 2008. Web. Aug. 13, 2015.*

(Continued)

*Primary Examiner* — Christopher S Kessler
*Assistant Examiner* — Jeremy C Jones
(74) *Attorney, Agent, or Firm* — Morgan, Lewis & Bockius LLP

(57) ABSTRACT

A wrought aluminium material with improved damage tolerance while preserving the high strength of the material is disclosed. Furthermore, a cast aluminium material of a precipitation hardenable aluminium alloy is disclosed, the material comprising grains having two distinct zones with a first centre zone enriched in elements capable of reacting peritectically with aluminium and a second zone, surrounding the first zone, enriched in elements capable of reacting eutectically with aluminium.

6 Claims, 2 Drawing Sheets

TWO-ZONE STRUCTURE
cross section

PROCESS

LAYERED MATERIAL STRUCTURE
cross section

(56) References Cited

U.S. PATENT DOCUMENTS

| | | | | |
|---|---|---|---|---|
| 5,300,157 | A | 4/1994 | Okabe et al. | |
| 5,908,518 | A | 6/1999 | Hoffmann et al. | |
| 6,120,623 | A * | 9/2000 | Gupta | C22C 21/08 148/417 |
| 6,685,782 | B1 | 2/2004 | Schwellinger | |
| 2001/0018940 | A1* | 9/2001 | Borst | C22C 21/02 148/440 |
| 2004/0261916 | A1 | 12/2004 | Lin et al. | |
| 2007/0243097 | A1 | 10/2007 | Sarrazin et al. | |
| 2008/0219882 | A1 | 9/2008 | Woydt | |
| 2010/0047114 | A1* | 2/2010 | Shibata | C22C 21/08 420/535 |

FOREIGN PATENT DOCUMENTS

| | | | |
|---|---|---|---|
| EP | 0808911 | | 11/1997 |
| EP | 0 823 489 | | 2/1998 |
| EP | 0936278 | | 8/1999 |
| EP | 1 413 636 | | 4/2004 |
| EP | 1785499 | | 5/2007 |
| EP | 2072628 | | 6/2009 |
| EP | 2088216 | | 8/2009 |
| EP | 2 103 701 | | 9/2009 |
| EP | 2 157 200 | | 2/2010 |
| EP | 2175042 | | 4/2010 |
| FR | 2 872 172 | | 12/2005 |
| GB | 1 264 162 | | 2/1972 |
| JP | 7-179969 | | 7/1995 |
| JP | 07-179969 | | 7/1995 |
| JP | 2000-169927 | A | 6/2000 |
| JP | 2000169927 | A * | 6/2000 |
| JP | 2003-155535 | | 5/2003 |
| JP | 2000-169927 | | 6/2006 |
| JP | 2008-076297 | | 4/2008 |
| JP | 2008-76297 | | 4/2008 |
| JP | 2009-46697 | | 3/2009 |
| JP | 2009046697 | A * | 3/2009 |
| JP | 2009-191351 | | 8/2009 |
| JP | 2009191351 | A * | 8/2009 |
| JP | 2009-270192 | | 11/2009 |
| JP | 2009270192 | A * | 11/2009 |
| JP | 5416433 | B2 * | 2/2014 |
| WO | 2007/094686 | | 8/2007 |

OTHER PUBLICATIONS

Machine Translation of JP 5416433 B2.*

International Search report for PCT/EP2010/055504 dated Feb. 24, 2011.

Zajac et al., "Optimisation of Magnesium Silicide Phase for Extrudability of AA 6063 and AA 6005 Alloys," Materials Science Forum, vols. 217-222 (1996), pp. 397-402.

Zajac et al., "Influence of cooling after homogenisation and reheating to extrusion on extrudability and final properties of AA 6063 and AA6082 alloys," Materials Science Forum, vols. 396-402, (2002), pp. 399-404.

European Search Report issued in corresponding European Patent Application No. 14151018 dated Mar. 31, 2014.

Various documents and communications from the opposition in European Patent Application No. 10717607.5, with a date range of Jul. 2016-Dec. 2017.

Informational Notice dated Feb. 1, 2018, regarding results of oral proceeding in European Patent Application No. 10717607.5.

Communication pursuant to Article 94(3) EPC dated Nov. 9, 2017, issued in divisional European Patent Application No. 14151018.0.

Office Action dated Jan. 30, 2018, issued in corresponding Canadian Patent Application No. 2,797,446.

Avazkonandeh-Gharavol et al., "Effect of partition coefficient on microsegregation during solidification of aluminium alloys", International Journal of Minerals, Metallurgy and Materials, vol. 21, No. 10, Oct. 2014, pp. 980-989.

Sun et al., "Effect of liquid diffusion coefficients on microstructure evolution during solidification of Al356.1 alloy", Transactions of Nonferrous Metals Society of China, 23(2013) pp. 3722-3728.

ASM International 2002, Chapter 4; "Grinding and Polishing", pp. 35-44.

Phillips, "Modern Metallographic Techniques and Their Applications", Wiley-Interscience, 1971, pp. 2-3.

Struers, "Metallographic preparation of aluminium and aluminium alloys", 2008, www.struers.com (6 pages).

Davis et al., Ed., "Aluminum and Aluminum Alloys", ("Solidification Structures of Aluminium Alloys Ingots") in ASM Specialty Handbook, 1993, pp. 523-531.

Porro et al., "Studio sulla colata continua e calcoli empirici delle velocità di abbassamento nella colata di lingotti di leghe leggere", Aluminio, vol. 23, 1954, pp. 23-34 (with partial translation).

Polmear, "Light Alloys, From Traditional Alloys to Nanocrystals", Fourth Edition, Elsevier, 2006, Chapter 3 (Wrought Aluminium Alloys), pp. 97-100.

Jaradeh, "The Effect of Processing Parameters and Alloy Composition on the Microstructure Formation and Quality of DC Cast Aluminium Alloys", Doctoral Thesis (KTH—Royal Institute of Technology, Sweden), 2006, pp. 1-46.

Razaz, "Casting practices influencing inclusion distribution in Al-billets", Degree project for master of science in engineering, mechanical engineering, Spring semester, Karlstads University, Sweden 2012, pp. 1-49.

Verma et al., "Influence of cooling rate on the Fe intermetallic formation in an AA6063 Al alloy", Journal of Alloys and Compounds 555, 2013, pp. 274-282.

Devadas et al., "Prediction of the Microstructure of DC Cast 6063 Billets and its Effect on Extrusion Processes", Proceedings: 5th International Aluminium Extrusion Technology Seminar, May 19-22, 1992 (Chicago, Il), pp. 121-128.

Eskin, "Physical Metallurgy of Direct Chill Casting of Aluminum Alloys," CRC Press (2008), p. 24.

Chvorinov's rule [Online]. Wikipedia, 2018 [retrieved on Feb. 26, 2018]. Retrieved from the Internet: <URL: https://en.wikipedia.org/Wiki/Chvorinov's_rule>.

Easton et al., "Partitioning of titanium during solidification of Aluminum alloys" Materials Science and Technology vol. 16, Sep. 2000, pp. 993-1000.

Yamauchi et al., "Development of Corrosion Resistant Brazing Sheet for Drawn Cup Type Evaporators Part 1: Alloy Development" SAE International, Detroit, MI (Mar. 1-5, 1993), 8 pages.

Aluminum Insight, Feb. 2010, 8 pages.

Trimet, Trimal-52—A New Aluminum Alloy for High Performance Spaceframe Construction, ver. 1 and ver. 2, 8 pages each.

Delivery Note (in German and with translation) dated Apr. 26, 2006 from Corus Aluminum Profiltechnik Bonn, with accompanying Teal Sheet, 4 pages.

Excerpt from Aluminum Taschenbuch, 16 ed. (2002), pp. 42-49 and 52-53.

Hatch, American Society of Metals, Chapter 2, Constitution of Alloys, Table 1 (pp. 26-27) 1984.

Hatch, American Society of Metals, Chapter 2, Constitution of Alloys, Solidification with local equilibrium (pp. 32-35) 1984.

Schneider et al., "Improvement of billet quality by use of a hot top mold with a two phase lubrication" Light Metals (1987) pp. 763-768.

C. Kammer, TALAT Lecture 3210, Continuous Casting of Aluminum European Aluminum Association (1999).

Submission in Opposition Proceedings for European Application No. 10717607.5 dated Aug. 28, 2015(with pp. 1-20 and Figs. 1 and 2).

Interlocutory decision in Opposition proceedings (Art. 101(3)(a) and 106(2) EPC) dated Jun. 1, 2018, issued in corresponding European Patent Application No. 110 717 607.5.

Communication pursuant to Article 94(3) EPC dated May 16, 2018, issued in corresponding European Patent Application No. 14151018.0.

First Office Action dated Mar. 20, 2018, issued in corresponding Chinese Patent Application No. 201710136351.9.

(56) References Cited

OTHER PUBLICATIONS

Statement setting out grounds of Appeal dated Oct. 9, 2018, issued in corresponding European Patent Application No. 10717607.5.
Anyalebechi, "Comparative study of the effects of solidification rate on the cast microstructures of aluminium alloys 6016 and 6009", EPD Congress 2006, Proceedings of a meeting held Mar. 12-16, 2006, San Antonio, Texas, Howard et al., Eds., pp. 733-744 (2006).

* cited by examiner

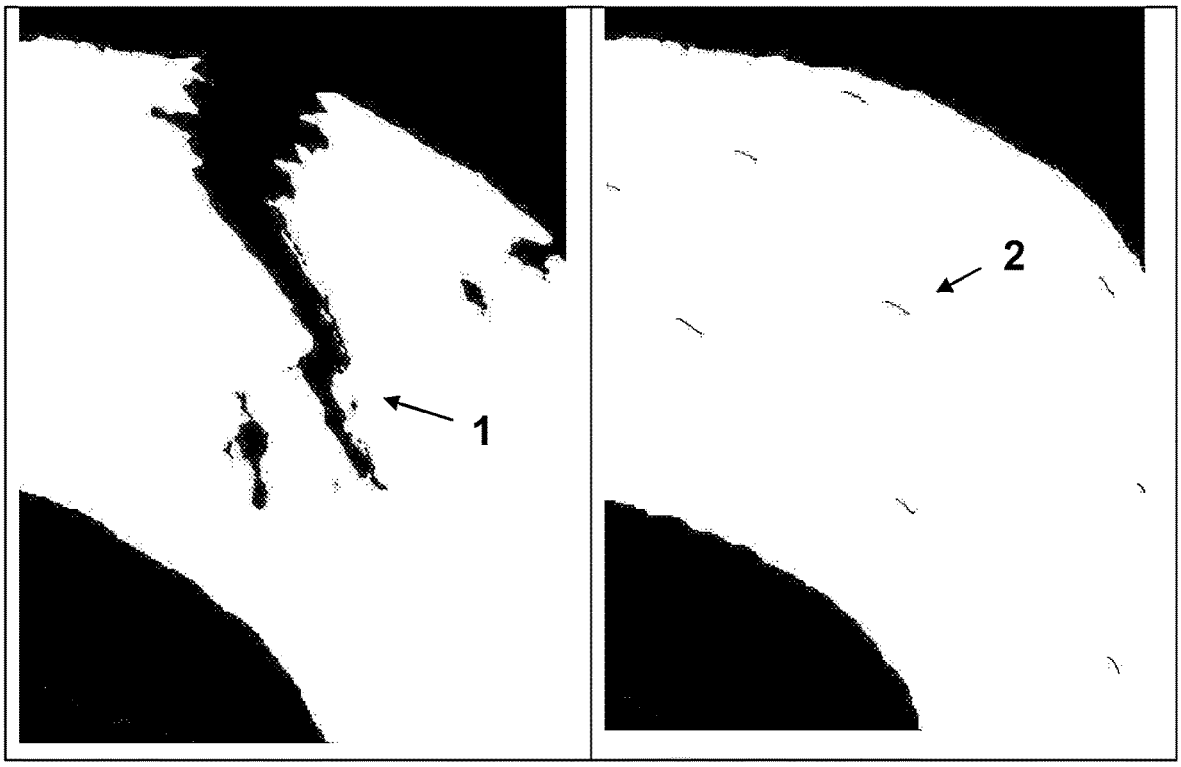
Figure 3 a) b)

DAMAGE TOLERANT ALUMINIUM MATERIAL HAVING A LAYERED MICROSTRUCTURE

The present invention relates to a damage tolerant aluminium material having a layered microstructure as well as to precipitation hardenable type aluminium alloys suitable for producing said aluminium material and to a method for producing said aluminium material.

BACKGROUND

The invention relates to the production of aluminium materials, and in particular to the production of damage tolerant wrought aluminium materials.

From the prior art it is known that for conventionally produced aluminium materials, strength, ductility and damage tolerance are generally inversely related to one another such that an increased level of tensile strength usually deteriorate ductility and damage tolerance In a previous method known from EP1987170 an alloy is used comprising wt %: Mn max 0.6, Cr max 0.3, Zr max 0.25, Mg 0.25-1.2, Si 0.3-1.4, Ti 0.1-0.4, where Ti is present in solid solution and incidental impurities, including Fe and Zn, up to 0.5 is included, with the balance being Al. The preferred Si/Mg-ratio is 1.4. The alloy is cast to billets and then homogenised and the billets are extruded to produce a material with improved crush resistant properties.

Extruded or rolled material resistant to stress corrosion cracking is presented in JP2008076297. The compositions used in this patent result in a conventional microstructure with a homogenous distribution of alloying elements. This patent also claims that the casting rate and cooling rate after casting must be high to keep the grain size of the cast structure small. A material of high damage tolerance is hereby not produced.

In EP2103701 an aluminium alloy comprising Si 0.68-0.77, Fe 0.16-0.24, Cu 0.24-0.32, Mn 0.68-0.77, Mg 0.58-0.67, Cr<0.04, Zn<0.1, Ti<0.1, V<0.04, other elements <0.3, balance Al is used to produce products for the automotive industry with a yield strength of more than 280 MPa.

SUMMARY OF THE INVENTION

It is an object of the present invention to provide conditions for enabling production of a wrought aluminium material with improved damage tolerance while preserving the high strength of the material.

The object is achieved by means of a cast aluminium material in accordance with independent claim 1, an aluminium alloy in accordance with independent claim 10 and a controlled method of producing a cast aluminium material in accordance with independent claim 12. Embodiments are given by the dependent claims.

A wrought aluminium material having a microstructure composed of alternating layers with significantly different mechanical properties providing a superior combination of strength, ductility and damage tolerance to the wrought aluminium material is thus achieved.

The layered structure is formed by deformation of an precipitation hardenable aluminium alloy comprising a cast structure composed of grains having two zones; a first centre zone enriched in elements capable of reacting peritectically with aluminium and a second zone, surrounding the first, enriched in elements capable of reacting eutectically with aluminium. In order to achieve an effect of the layered structure the aluminium alloy should comprise peritectic alloying elements with a combined partition coefficient of above 3, preferentially above 5 and most preferentially above 8, at a proportion of more than 0.02 times the content of wt % eutectic elements.

The invention provides an aluminium material of an precipitation hardenable aluminium alloy comprising a cast structure composed of grains, dendrites or cells having two distinct zones with a first centre zone enriched in elements capable of reacting peritectically with aluminium and a second zone, surrounding the first zone, enriched in elements capable of reacting eutectically with aluminium, the first zone occupying 1-85%, preferably 10-70%, most preferably 20-50% of the total billet volume measured on the cross section as peritectic hills in the interference contrast in LOM.

The invention further provides a wrought aluminium material produced by deformation of the cast aluminium material, whereby a material with a layered microstructure is produced, as well as a method for producing said material by controlling the casting speed so as to produce a two-zone cast structure, the first zone occupying 1-85%, preferably 10-70%, most preferably 20-50% of the total volume measured on the cross section as peritectic hills in the interference contrast in LOM.

The wrought aluminium material is an excellent candidate material especially in applications requiring damage tolerance, such as automobile parts where damage tolerance is a prerequisite.

BRIEF DESCRIPTION OF THE DRAWINGS

FIGS. 3*a* and 3*b* compares damage tolerance in bending of two aluminium materials with the same strength level, wherein a) shows a conventional aluminium material and b) shows an aluminium material according to the present invention, and wherein the reference numbers signifies 1—perpendicular crack, 2—small arrested longitudinal cracks.

DETAILED DESCRIPTION OF THE INVENTION

Figure 1:
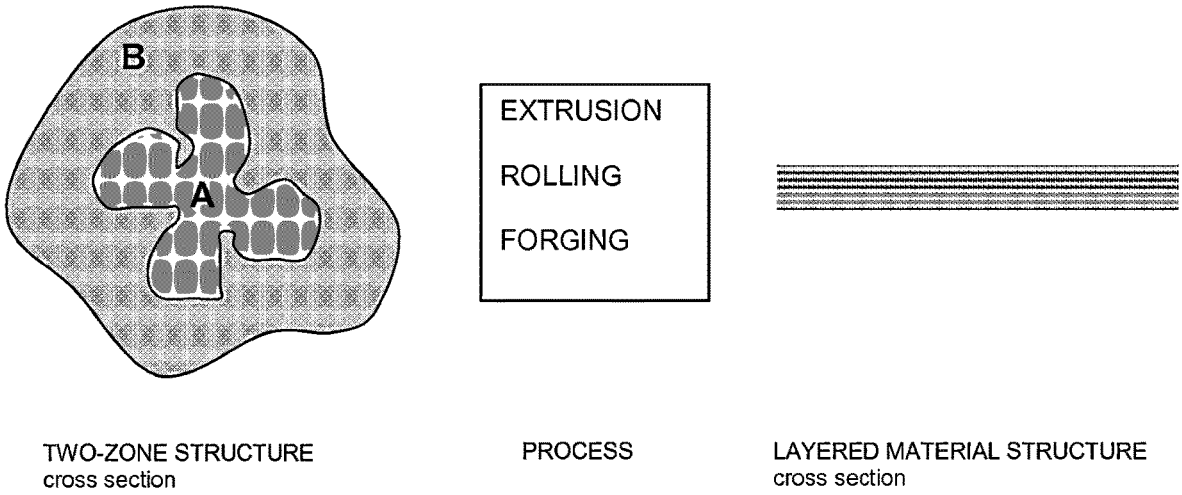
FIG. 1 shows a schematic drawing of a cross section of the as-cast material according to the present invention, wherein A signifies the centre zone enriched in peritectic elements and B signifies the surrounding zone enriched in eutectic elements in a grain, a schematic process diagram, and a schematic drawing of a layered structure obtained after deformation.

In this invention the damage tolerant wrought aluminium material is composed of alternating layers with significantly different mechanical properties which remain distinct on a microscopic level within the finished structure, see FIG. 1. This layered structure exhibits enhanced degree of damage tolerance at high strength. Damage tolerance is a property of a structure relating to its ability to sustain defects safely.

The present invention provides in one aspect a process for producing a damage tolerant aluminium material in which the casting process produces a cast structure composed of grains having two zones; in which 1-85% of their volume consists of a zone enriched in peritectic elements, hereinafter called the "peritectic zone" and 15-99%, of the volume consisting of a surrounding zone enriched in eutectic elements, hereinafter called the "eutectic zone". The solidification process of the invention is referred to as extended peritectic solidification, and we have found that at a given proportion of selected peritectic alloying elements in relation to eutectic elements, a cast structure with two distinct zones with different compositions is formed within each grain, as opposed to a conventional homogenous cast structure. This extended peritectic solidification leads to a very strong redistribution of alloying elements, yielding the desired two-zone structure. The development of the two-zone structure is dependent on the control of the casting process, e g the geometry of the casting, the casting speed, the metal head and temperature of the melt.

The peritectic zone is defined as a microstructure constituent which has at least 0.02×[wt % eutectic elements]×[Σk of peritectic elements], wherein Σk is the combined partition coefficient. The peritectic elements are able to suppress the local content of eutectic elements to a fraction of the alloy content. In that way the desired two zone microstructure is formed.

Figure 2:
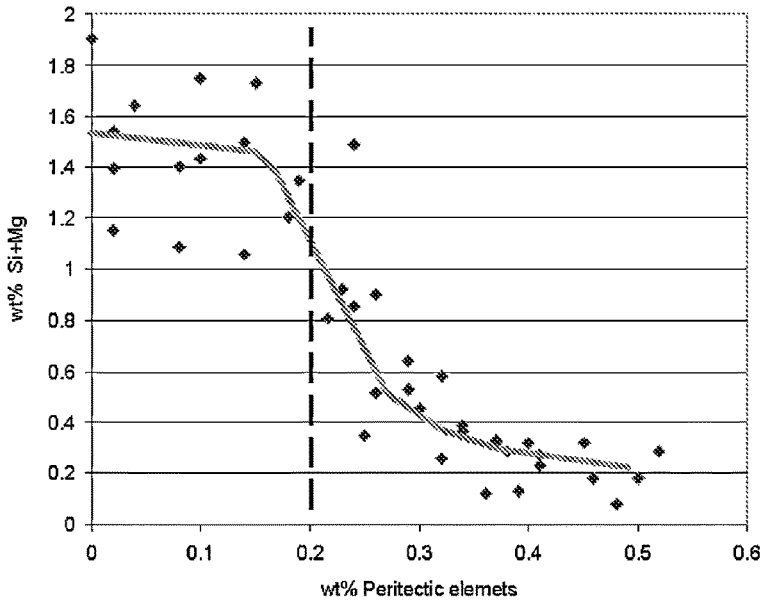
FIG. 2 shows the redistribution of Mg+Si— in different areas of a grain for the solidified AlMgSi alloy containing 1.2% (Mg+Si) as a function of the content of wt % of peritectic alloying elements in these areas, revealed by Energy Dispersive X-ray Spectroscopy.

FIG. 2 shows an example of eutectic element redistribution within one grain as a function of the local content of peritectic alloying elements revealed by Energy Dispersive X-ray Spectroscopy for an AlMgSi alloy with about 1.2 wt % of Mg+Si. It is clearly seen that when the local content of peritectic alloying elements is above 0.2% then a microstructure with two distinct zones is formed (the Mg+Si—rich zone and Mg+Si—poor zone), with an Mg+Si ratio between the second and the first zone of 1:2 or less.

The strength of peritectic alloying elements is defined by their combined partition coefficients Σk which must be above 3, preferentially above 5 and most preferentially above 8, and their content which must be above 0.02×[wt % eutectic alloying elements], enabling a suppression of the local eutectic element content in the peritectic zone to <0.8×[the average eutectic alloying elements content of the alloy in wt %]. Below a partition coefficient of 3 the two zone structure is not produced. If the partition coefficient is more than 3, but less than 8, the two zone structure is formed but is less pronounced and may thus for some cases not provide a sufficient layered structure in the wrought product.

The combined partition coefficient is calculated as a sum of the individual coefficients for binary system at the peritectic temperature; (7.5 for Ti, 3.9 for V, 2.5 for Mo, 1.9 for Nb, 2.5 for Zr, 2 for Cr, 1.1 for Zn, 2.7 for W, 2.4 for Hf, 2.5 for Ta).

The solidification rate of the precipitation hardenable aluminium alloy with the addition of peritectic elements during casting must be slow to give sufficient time for the redistribution described above and to produce a microstructure with at least 1% of peritectic zone. The development of the two-zone structure is dependent on the control of the casting process, as mentioned above, and thus the solidification rate. The solidification rate should preferably be such that it corresponds to a casting rate of maximally 90 mm/min under the conditions of the examples given below, reference being made especially to Table 2. Generally, the solidification time, i.e. the time between completely liquid and completely solidified material, during casting should be controlled to at least 75 seconds, preferably at least 100 seconds, for all compositions of the alloy within the scope of the invention.

After shaping of the cast material, such as rolling, extrusion, or forging, a layered structure of alternate soft and hard layers is obtained. For this reason the layered material obtained from a peritectic/eutectic starting structure in accordance with this invention gives rise to superior combinations of damage tolerance and tensile strength.

After casting, the aluminium alloy may be homogenised. The aim of the homogenising treatment is usually to dissolve Mg and Si, to level off possible residual stresses resulting from the casting process, to form dispersoid type particles for controlling the wrought grain structure, and to spheroidise sharp or needle shaped intermetallic compounds formed during solidification of the aluminium alloy. According to the present invention a redistribution of the alloying elements is not desired. Therefore, if the material is to be homogenized, a low homogenisation temperature is favoured against a high homogenisation temperature, with the main aim of increasing the difference in mechanical properties between the zones After homogenisation, the alloy is cooled, for example by means of air cooling. Further the alloy may be preheated, preferably to a temperature in the range of less than 500° C. and extruded, rolled of forged. After extrusion, rolling or forging the aluminium alloy of the invention is quenched, ideally press-quenched, for example by means of water, water spray, forced air, other cooling liquid or by means of nitrogen.

In a following step, the material is aged to desired level of mechanical and physical properties. Preferably, the alloy of the present invention is artificially aged to a desired temper, which would ideally be an overaged temper such as T7, in particular when used for applications requiring a high capacity for absorbing kinetic energy by plastic deformation. Alternatively the aluminium alloy can be aged to a T6 condition for higher strength or to an underaged condition, or subjected to a stabilisation anneal at a temperature in a range of 50 to 120° C. to improve cold formability and/or additional heat treatment response.

After the complete processing treatment cycle, the material can be processed into products of many kinds. The aluminium alloy is particularly suitable for applications which, amongst other things, require a high damage tolerance, such as crash components suitable for application in automotive and railway vehicles. Although the aluminium alloy according to the invention is preferably processed via extrusion, it is also suitable in rolled and forged constructions, for example as a suspension part in a car, for which damage intolerant material has an adverse effect on the fatigue performance of the component.

The increased ductility and damage tolerance is due to a layered structure, which increases the strain to the onset of necking and retards the localisation of strain during necking, and to an increased resistance to fracture, which is reflected in increased true fracture strains.

Selection of Alloying Elements

The improved properties are not critically dependent upon the composition of the aluminium, provided that the desired microstructure can be developed. Thus, all precipitation hardenable aluminium alloys, such as 2XXX, 6XXX, 7XXX and 8XXX alloys, may be used to produce the material according to the invention.

It has been found that in order to obtain an adequate level of strength AlMgSi alloys containing 0.3-1.5% Mg and 0.3-1.5% Si should have peritectic alloy additions of at least 0.02×[wt % eutectic alloying elements] sufficient to produce an adequate amount of two-component structure in the cast and homogenised material and to produce a layered structure after hot processing. Elements capable of a peritectic reaction with Al are Nb, Ti, V, Mo, Cr, Zn, Zr, Hf, Ta, and W.

A preferred composition according to the present invention is given by an aluminium alloy comprising the alloying elements, in wt. %:

Si 0.3 to 1.5, preferably 0.5-1.1

Mg 0.3 to 1.5, preferably 0.5-1.5, and more preferably 0.65-1.2

Cu<0.5, preferably <0.4, most preferably <0.25

Mn<0.6, preferable 0.05-0.3, more preferably 0.08 to 0.15

Nb<0.3, preferably 0.02 to 0.15,

V<0.3

Ti<0.2

Mo<0.2

Cr<0.3

Zr<0.2

Zn<0.2

Fe<0.5, preferably <0.3 and inevitable impurities each <0.05, total <0.15, and balance aluminium.

For optimising the strength of the Al—Mg—Si alloys, the Mg and Si content should be chosen so as to ensure that as much Mg and Si as possible is used for making hardening precipitates. It is commonly known that the hardening particles have a molar Si/Mg ratio of approximately 1. The Si content is in a range of 0.3% to 1.5%, preferably 0.5-1.1%. In this range the strength is optimized when used in combination with the Mg content in a range of 0.3% to 1.5%, preferably in a range of 0.5% to 1.5%, and more preferably in a range of 0.65% to 1.2%. The range Mg/Si should preferably >1, so that a surplus of Mg is formed. By surplus Mg or Si it should be understood the Mg or Si that does not form precipitates. The surplus Mg contributes little to the overall strength of the material but has a positive effect on the strength of grain boundaries. The surplus Mg limits the diffusion of Si to grain boundaries and is important in improving damage tolerance in combination with the layered structure.

With a Mn content in the range of <0.6%, preferably in the range of 0.05% to 0.3%, and more preferably in the range of 0.08% to 0.15%, the aluminium alloy in accordance with the invention is less sensitive for hot-cracking during and after extrusion and heat-treatments and provides a fine-grained recrystallized microstructure. Moreover with a Mn content in the above mentioned range an optimum in mechanical properties and extrudability is obtained by the beneficial effect of Mn on the hot ductility and on the formation of alpha-type Fe-containing intermetallics.

The peritectic alloying elements must be selected in such a way as to obtain a combined partition coefficient $\Sigma k$ above 3, preferentially above 5 and most preferentially above 8 and the strength of peritectic reaction of above 0.02×[wt % eutectic elements]×[$\Sigma k$]. The empirical results indicate that there is an additional synergy effect between peritectic alloying elements selected from; Ti, Zr, V, Mo, Cr, Zn, Hf, Ta, and W, preferably; Ti, Zr, V, Cr, Mo and Nb and most preferably Ti, V, Mo and Nb able to increase the power of peritectic reaction above that calculated from a sum of the individual coefficients for binary system at the peritectic temperature×$\Sigma k$ (<8).

Cu can be present in the aluminium alloy according to the invention up to 0.5%. In a preferred embodiment Cu is present at 0.4% maximum, and more preferably 0.25% maximum.

The optional addition of Cr and/or Zr is not only used to strengthen the peritectic component but also to control the grain structure. Therefore, one or both of Cr and Zr can be added in a range of <0.3% Cr and/or <0.2% Zr. When added a non-recrystallised grain structure may be obtained.

Zn is considered to be an impurity element and can be tolerated up to 0.2%, but is preferably less than 0.1%.

Although Fe provides a slight increase in strength, it should be present in an amount not more than 0.5%, preferably less than 0.3% to reduce the risk of adverse formation of intermetallic particles which could initiate fracture during use of the final component.

The balance is aluminium and inevitable impurities, such as resulting from the raw material used or the manufacturing process. Typically each impurity element is present at 0.05 wt. % maximum and the total of impurities is 0.15 wt. % maximum.

The invention is now illustrated by some examples, which do not limit the scope of the invention.

Examples

Table 1 lists the chemical compositions in weight percent of some comparative materials (alloys C, E, F, G) and alloys which fall within the scope of the present invention (alloys A, B, D). All these aluminium alloys were DC cast to evaluate the effect of composition and casting speed on the development of the peritectic component.

Table 2 gives the list of alloys and casting speeds of some comparative variants and variants which produced the cast structure with above 20% of peritectic component according to the present invention (variants A2, A3 and B2, B3).

The casting billets having a diameter of 254 mm with the peritectic component above 20% (variants A2 and B2 and D) and the comparative materials (alloys C, E-G) were processed by the steps of:

Homogenizing by holding at 545° C.;

air cooling;

preheating to about 460° C.;

extruding with a two hole die into a box profile;

press-quenching with water;

ageing with different practices.

A comparison of alloy B and D with a similar peritectic/eutectic element ratio indicates that an addition of Nb to the alloy gives rise to a two zone structure, while the addition of Cr does not provide this effect. Nb does therefore seem to give a synergetic effect with the other alloying elements, in addition to what is expected by its contribution to the overall peritectic reaction.

Table 3 shows the mechanical properties of the alloys A2, B2, C and D in T6 (195° C. for 4.5 h). "Rm" is the ultimate tensile strength, "Rp0.2" is the 0.2% yield strength and A5 (the elongation at fracture). Damage tolerance is defined as a measure of development of perpendicular cracks. When such cracks are developed as shown in FIG. 3, the material is considered not damage tolerant. A comparison of the behaviour in bending of one-component material with the two-component material according to the present invention is shown in FIG. 3. In FIG. 3*b*, showing the material according to the invention, only small arrested layered cracks are visible. The layered material according to the invention is able to arrest short layered cracks between the layers as compared to extensive perpendicular cracking of the comparative material (FIG. 3*a*).

TABLE 1

Chemical composition of alloys A-G, all in wt %, balanced aluminium and unavoidable impurities.

| Alloy | | Mg | Si | Nb | V | Ti | Mn | Fe | Cu | Peritectic elements/ Eutectic elements ratio | Mg/Si Ratio |
|---|---|---|---|---|---|---|---|---|---|---|---|
| A | Invention | 0.83 | 0.61 | 0.02 | 0.08 | 0.05 | 0.09 | 0.19 | 0.12 | 0.104 | 1.36 |
| B | Invention | 0.95 | 0.58 | 0.05 | 0.06 | 0.04 | 0.1 | 0.19 | 0.2 | 0.098 | 1.64 |
| C | Comparative | 0.62 | 0.93 | — | — | — | 0.5 | 0.2 | 0.08 | 0.013 | 0.67 |
| D | Invention | 0.6 | 0.65 | — | 0.05 | — | 0.16 | 0.19 | 0.21 | 0.056 | 0.92 |
| E | Comparative | 0.58 | 0.63 | — | 0.02 | — | 0.1 | 0.18 | 0.2 | 0.033 | 0.92 |
| F | Comparative | 0.55 | 0.58 | — | — | — | 0.15 | 0.21 | 0.08 | 0.027 | 0.95 |
| G | Comparative | 0.83 | 0.61 | — | — | — | 0.04 | 0.2 | 0.2 | 0.014 | 1.36 |

TABLE 2

Casting speed and the development of peritectic component above 20% after casting of 10" billets and the subsequent layered structure of the final material.

| Alloy | Cast material | Casting speed millimeters/ minute | Peritectic Component above 20% | Layered structure in the final material |
|---|---|---|---|---|
| A1 | Invention | 80 | YES | YES |
| A2 | Invention | 85 | YES | YES |
| A3 | Comparative | 90 | NO | NO |
| B1 | Invention | 80 | YES | YES |
| B2 | Invention | 85 | YES | YES |
| B3 | Comparative | 90 | NO | NO |
| C | Comparative | 85 | NO | NO |
| D | Comparative | 95 | NO | NO |
| E | Comparative | 85 | NO | NO |
| F | Comparative | 85 | NO | NO |
| G | Comparative | 85 | NO | NO |

TABLE 3

Mechanical properties and damage tolerance of the alloys in T6 (195° C. for 4.5 h)

| | Ageing 195° C. for 4.5 hours | | | |
|---|---|---|---|---|
| Alloy | Rp0.2 (MPa) | Rm (MPa) | A5 (%) | Damage tolerance |
| A2 | 297 | 311 | 12.5 | YES |
| B2 | 301 | 317 | 12.6 | YES |
| C | 309 | 328 | 12.2 | NO |
| D | 289 | 303 | 13.2 | NO |

The invention claimed is:

1. A method of producing a wrought aluminium material, comprising the steps:

producing a cast aluminium material of a precipitation hardenable aluminium alloy, wherein the precipitation hardenable aluminium alloy consists of, in wt %:

0.3-1.5 Si, 0.3-1.5 Mg,

≤0.3 Mn,

<0.5 Cu,

<0.5 Fe,

<0.3 Nb,

<0.3 V,

<0.3 Cr,

<0.2 Zn,

<0.2 Ti,

<0.2 Mo,

<0.2 Zr, and unavoidable impurities each 0.05 wt. % maximum and the total of impurities 0.15 wt. % maximum, and balance aluminium, wherein the cast material further comprises grains, dendrites or cells having a two-zone cast structure with two distinct zones including a first centre zone enriched in elements capable of reacting peritectically with aluminium and a second zone, surrounding the first zone, enriched in elements capable of reacting eutectically with aluminium, the first zone occupying 20-50% of the total volume measured on the cross section as peritectic hills in the interference contrast in LOM, wherein the precipitation hardenable aluminium alloy comprises peritectic alloying elements with a combined partition coefficient Σk of above 3 and a proportion of peritectic elements of more than 0.02×[wt % eutectic alloying elements] able to suppress the local eutectic element content in the peritectic zone to <0.8×[the average eutectic alloying elements content of the alloy in wt %], and wherein the precipitation hardenable aluminium alloy is cast while controlling the casting speed so as to produce the two-zone cast structure, wherein the solidification time during casting is controlled to at least 75 seconds;

optionally homogenising the cast material with the two-zone cast structure at homogenization conditions that preserve the two distinct zones of the cast material;

optionally preheating the billet;

deforming the cast structure to produce a material with a layered structure comprising alternate layers of different mechanical properties;

cooling said material; and optionally heat treating said material.

2. The method according to claim 1, where the material is deformed by extrusion or forging.

3. The method according to claim 1, wherein the combined partition coefficient Σk is above 5.

4. The method according to claim 3, wherein the combined partition coefficient Σk is above 8.

5. The method according to claim 1, wherein the Mg/Si ratio of the precipitation hardenable aluminium alloy is >1.

6. A method of producing a wrought aluminium material, comprising the steps:

producing a cast aluminium material of a precipitation hardenable aluminium alloy, wherein the precipitation hardenable aluminium alloy consists of, in wt %:

0.3-1.5 Si, 0.3-1.5 Mg,

≤0.3 Mn,
<0.5 Cu,
<0.5 Fe,
<0.3 Nb,
<0.3 V,
<0.3 Cr,
<0.2 Zn,
<0.2 Ti,
<0.2 Mo,
<0.2 Zr, and
unavoidable impurities each 0.05 wt. % maximum and the total of impurities 0.15 wt. % maximum, and
balance aluminium, wherein the cast material further comprises grains, dendrites or cells having a two-zone cast structure with two distinct zones including a first centre zone enriched in elements capable of reacting peritectically with aluminium and a second zone, surrounding the first zone, enriched in elements capable of reacting eutectically with aluminium, the first zone occupying 20-50% of the total volume measured on the cross section as peritectic hills in the interference contrast in LOM, wherein the precipitation hardenable aluminium alloy comprises peritectic alloying elements with a combined partition coefficient Σk of above 3 and a proportion of peritectic elements of more than 0.02×[wt % eutectic alloying elements] able to suppress the local eutectic element content in the peritectic zone to <0.8×[the average eutectic alloying elements content of the alloy in wt %], and wherein the precipitation hardenable aluminium alloy is cast while controlling the casting speed so as to produce the two-zone cast structure, and wherein the solidification time during casting is controlled to at least 75 seconds;

optionally preheating the cast material comprising the two-zone cast structure;

deforming the cast material comprising the two-zone cast structure to produce a material with a layered structure comprising alternate layers of different mechanical properties;

cooling said material; and optionally heat treating said material.

* * * * *